US005766827A

United States Patent [19]

Bills et al.

[11] Patent Number: 5,766,827

[45] Date of Patent: Jun. 16, 1998

[54] PROCESS OF IMAGING BLACK METAL THERMALLY IMAGEABLE TRANSPARENCY ELEMENTS

[75] Inventors: Richard E. Bills; Hsin-hsin Chou, both of Woodbury; Thomas A. Isberg, Apple Valley; Charles C. Lee, Little Canada; William V. Dower, St. Paul; Martin B. Wolk; John S. Staral, both of Woodbury, all of Minn.

[73] Assignee: Minnesota Mining and Manufacturing Co., St. Paul, Minn.

[21] Appl. No.: 800,010

[22] Filed: Feb. 13, 1997

Related U.S. Application Data

[63] Continuation of Ser. No. 405,513, Mar. 16, 1995, abandoned.

[51] Int. Cl.[6] ..... G03C 5/56

[52] U.S. Cl. ..... 430/346; 430/200; 430/201; 430/945; 430/964

[58] Field of Search ..... 430/346, 200, 430/201, 945, 964

[56] References Cited

U.S. PATENT DOCUMENTS

| | | | |
|---|---|---|---|
| 3,474,457 | 10/1969 | Becker | 347/249 |
| 3,560,258 | 2/1971 | Brisbane | 430/319 |
| 3,560,994 | 2/1971 | Wolf et al. | 430/524 |
| 3,720,784 | 3/1973 | Maydan et al. | 358/334 |
| 3,902,180 | 8/1975 | Sobajima et al. | 347/164 |
| 3,911,444 | 10/1975 | Lou et al. | 347/262 |
| 3,924,093 | 12/1975 | Feldman et al. | 219/121.69 |
| 4,188,214 | 2/1980 | Kido et al. | 430/494 |
| 4,430,366 | 2/1984 | Crawford et al. | 427/162 |
| 4,599,298 | 7/1986 | Fisch | 430/271 |
| 4,657,840 | 4/1987 | Fisch | 430/201 |
| 4,999,278 | 3/1991 | Bouldin | 430/270 |
| 5,171,650 | 12/1992 | Ellis et al. | 430/20 |
| 5,302,493 | 4/1994 | Strandjord et al. | 430/321 |
| 5,308,737 | 5/1994 | Bills et al. | 430/201 |

FOREIGN PATENT DOCUMENTS

| | | |
|---|---|---|
| 0 489 972 A1 | 6/1992 | European Pat. Off. . |
| 58-7394 | 1/1983 | Japan . |
| WO 86/00575 | 1/1986 | WIPO . |
| WO 94/04368 | 3/1994 | WIPO . |

*Primary Examiner*—John A. McPherson
*Attorney, Agent, or Firm*—H. Sanders Gwin

[57] ABSTRACT

A process for forming an image on a transparent or translucent substrate comprising the steps of providing an imageable element comprising a transparent or translucent glass or polymeric film having a coating of a black metal on one surface thereof, directing radiation in an imagewise distributed pattern at said black metal layer with sufficient intensity to substantially increase the light transmissivity of the medium in the irradiated region in an imagewise distributed pattern, said element having no layers comprising a thermally activated gas-generating composition. The image comprises residual black metal on the film base, and may be used for overhead transparencies, contact negatives/positives, and the like.

13 Claims, 1 Drawing Sheet

PROCESS OF IMAGING BLACK METAL THERMALLY IMAGEABLE TRANSPARENCY ELEMENTS

This is a continuation of application Ser. No. 08/405,513 filed Mar. 16, 1995, now abandoned.

FIELD OF THE INVENTION

This invention relates to thermally imageable materials for the production of black-and-white transparent images, including proofs, printing plates, contact films, overhead transparencies, and other graphic arts media using thermal imaging methods. More particularly, this invention relates to black metal coated thermally imageable elements.

BACKGROUND OF THE INVENTION

Laser induced thermal transfer of materials from a donor sheet to a receptor layer has been described in the patent and technical literature for nearly thirty years. However, few commercial systems have utilized this technology. Exposure fluences required to transfer materials to a receptor have been, at best, on the order of 0.1 Joule/cm$^2$ (i.e., 0.1 J/cm$^2$). Consequently, lasers capable of emitting more than 5 Watts of power, typically water-cooled Nd:YAG lasers, have been required to produce large format images (A3 or larger) in reasonable times. These lasers are expensive and impractical for many applications. More recently, single-mode laser diodes and diode-pumped lasers producing 0.1–4 Watts in the near infrared region of the electromagnetic spectrum have become commercially available. Diode-pumped Nd:YAG lasers are good examples of this type of source. They are compact, efficient, and relatively inexpensive.

Separately addressed laser diode arrays have been utilized to transfer dyes in color proofing systems. For example, U.S. Pat. No. 5,017,547 describes the binderless transfer of dye from a dye-binder donor sheet to a polymeric receptor sheet. In that process, dye molecules are vaporized or sublimed by a laser. These dye molecules traverse the gap between the donor and receptor and recondense on the receiver. The donor and receptor are separated by spacer beads. This technique has several disadvantages. First, the state change of dye (i.e., solid to vapor) requires high energy fluences (~0.5 J/cm$^2$) and relatively long pixel dwell times (~10 μsec), thus requiring multiple beam arrays for rapid imaging of large format areas. A plastic-coated receptor is required for proper laser addressed transfer. The image on this receptor must then be retransferred to plain paper, a step that adds cost, complexity, and time to the printing process.

U.S. Pat. No. 3,978,247 discloses the use of binderless, abrasion-resistant dyes coated on transparent donors. The dyes employed have low vaporization temperatures and low heats of vaporization. The binderless coating contains less thermal mass and therefore, the exposure energy required to transfer the dye should be less than that required in the system of U.S. Pat. No. 5,017,547.

Exothermic heat-producing reactions have been used for the thermal transfer of inks. For example, in U.S. Pat. No. 4,549,824 aromatic azido compounds were incorporated into thermal transfer inks. When heated to 170° C., the aromatic azido compound melts the ink and allows it to flow into a receptor, such as plain paper. The heat generated by the decomposition of the aromatic azido compound reduces the amount of heat that must be supplied by the thermal head or laser source, thereby improving the overall imaging throughput. However, the process occurs over a relatively long time scale (≧1 msec), thereby resulting in significant heat diffusion and heat loss. In addition, pressure between the donor and receptor is required to maintain uniform transfer. An optically transparent means of applying pressure (e.g., a cylindrical lens or a flat glass plate) is difficult to employ in high resolution laser-based imaging systems.

Laser induced propulsive transfer processes can be used to achieve exposure fluences and pixel dwell times that are substantially less in thermal transfer processes than those of the previously disclosed processes. U.S. Pat. No. 3,787,210 discloses the use of laser induced propulsive transfer to create a positive and negative image on film. A clear substrate was coated with heat-absorbing particles dispersed in a self-oxidizing binder. In that patent, the heat absorber was carbon black and the binder was nitrocellulose. The donor sheet was held in intimate contact with a receptor. When the coating was locally heated with a laser, combustion in the binder was initiated, thus blowing the carbon black onto the receptor. The receptor could be paper, adhesive film, or other media. The self-oxidizing binder was employed to reduce the exposure fluence required to achieve imaging.

In U.S. Pat. No. 3,964,389, crosslinkable resins were added to a carbon black/nitrocellulose coating and the material was transferred to aluminum by imagewise heating with a laser. The resin was thermally crosslinked on the aluminum to produce a lithographic printing plate.

U.S. Pat. No. 3,962,513 discloses the use of a dual-layer coating construction for the production of lithographic printing plates. The first layer was a coating of carbon black and nitrocellulose binder coated on top of a clear substrate. An overlying layer of crosslinkable, ink-receptive resin was coated over this propellant layer. Upon laser heating, the resin was transferred to an aluminum plate. The run length and the image sharpness of the resulting plate were improved with this construction.

Nitrocellulose propellant layers have several undesirable characteristics when employed in imaging systems, as pointed out in British Patent Application No. 2,176,018. For example, mixed oxides of nitrogen are produced during decomposition of nitrocellulose, forming a corrosive acid that can damage the imaging apparatus. Nitrocellulose with high nitration levels is required to produce sufficient amounts of gas during imaging. However, this form of nitrocellulose presents safety and storage risks (explosion hazard).

U.S. Pat. No. 4,245,003 discloses the use of graphite in an ethyl cellulose binder for producing films. By using graphite, the imaged areas of the negative transparency were blown clean. In that case, the binder was not self-oxidizing. No exposure fluence information was disclosed. Graphite images are not highly useful in contact imaging applications.

U.S. Pat. No. 5,171,650 discloses methods and materials for thermal imaging using an "ablation-transfer" technique. The donor element for that imaging process comprises a support, an intermediate dynamic release layer, and an ablative carrier topcoat. The topcoat carries the colorant. The dynamic release layer may also contain infrared-absorbing (light to heat conversion) dyes or pigments. The pigments also include black copper as an additive. Nitrocellulose as a binder was disclosed.

Copending U.S. patent application Ser. No. 07/855,799 discloses ablative imaging elements comprising a substrate coated on a portion thereof with an energy sensitive layer comprising a glycidyl azide polymer in combination with a radiation absorber. Demonstrated imaging sources were infrared, visible, and ultraviolet lasers. Solid state lasers were disclosed as exposure sources although laser diodes were not specifically mentioned. That application concerns formation of relief printing plates and lithographic plates by ablation of the energy sensitive layer. No mention of utility for thermal mass transfer was made.

Copending U.S. patent application Ser. No. 08/033,112, filed on Mar. 18, 1993, now U.S. Pat. No. 5,308,737, discloses the use of black metal layers on polymeric substrates with gas-producing polymer layers which generate relatively high volumes of gas when irradiated. The black aluminum absorbs the radiation efficiently and converts it to heat for the gas-generating materials. It is observed in the examples that in some cases the black metal was eliminated from the substrate, leaving a positive image on the substrate.

U.S. Pat. Nos. 4,599,298 and 4,657,840 disclose an imagable article comprising in sequence a substrate, a vapor-deposited colorant layer, and a vapor-deposited graded metal/metal oxide or metal sulfide layer. The colorant is used to form the image either by ablating the metal layer and thermally transferring the colorant to a receptor, or alternately ablating the metal layer and directly providing a colored image in the opposite mode through the metal background.

European Patent App. No. 489,972 discloses a heat-sensitive recording material comprising a support layer, a binder layer containing at least one dye or dye precursor, preferably coated from an aqueous medium, and a metal layer ablatable by light of a high intensity laser beam. The dye or dye precursor is used to form the image after ablating the metal layer by transferring the dye or dye precursor, either by heat or by an aqueous liquid, to a receptor element.

U.S. Pat. No. 4,188,214 discloses a transfer imaging system which can be addressed by lasers to transfer an image onto one surface or remove material from the original sheet to form an image thereon. The media comprises a substrate having a coating on one side which comprises a metal and another material mixed therein. Amongst the materials are included some metal oxides, metal sulfides and other inorganic materials. A proportion of 1:5 to 1:30 volume percent of the metal oxide (if used) to the metal is discloseded in the practice of that invention. Those proportions equate to a ratio of about 3.5 to 16 atomic percent (molar percent) of oxygen to aluminum if aluminum were used as the metal and the metal in the metal oxide.

SUMMARY OF THE INVENTION

In accordance with the present invention, it has now been discovered that a thermally addressed element comprising a transparent (or translucent) substrate free of gas-producing polymer (polymers with a thermally available nitrogen content of greater than about 5 weight percent (as defined later herein) and having a black metal coating on one surface thereof can be used in a thermally addressed imaging process to produce a sharp black-and-transparent image on the substrate. The element is directly addressed and the image is immediately formed thereon.

The present invention is a method for producing visible images on a glass or polymeric film comprising the steps of:

1) providing a thermally imageable medium comprising a glass or polymeric film substrate having on one surface thereof an opaque (a white light transmission optical density of at least 0.3, preferably at least 0.6, more preferably at least 0.8, and most preferably at least 1.0) black metal layer comprising aluminum and aluminum oxide with an atomic percent of at least 19% to less than 58% oxygen (as compared to the total number of oxygen and aluminium atoms) in the black metal, which black metal layer can be transparentized by the local application of heat, 2) directing radiation at said medium so that sufficient radiation is absorbed by said black metal layer to transparentize it in areas where said radiation strikes said black metal layer, without burning said substrate, said substrate being free of layers on said substrate which generate at least 5% by volume of gas (e.g., which have less than 5% thermally available gas content) when struck by said radiation which transparentizes said black metal layer.

As used herein:

"thermally available gas content" and "thermally available nitrogen content" refers to the gas or nitrogen content (weight percentage basis) of a material which upon exposure to heat (preferably less than about 300° C. and more preferably less than about 250° C.) generates or liberates nitrogen ($N_2$) gas;

"thermally decomposable nitrogen-containing group" refers to a nitrogen-containing group (e.g., azido, nitrate, nitro, triazole, etc.) which upon exposure to heat (preferably less than about 300° C., more preferably less than about 250° C.) generates or liberates $N_2$ gas.

"thermally ablative transfer material" or "element" or "medium" refers to a medium which is ablated in thermal imaging processes by the action of a thermal source, by a rapid removal of material from the surface but without sublimation of the material;

"transparentize" or "transparentization" refers to a process in which a substantial increase in the light transmissivity of the medium is observed (e.g., through vaporization, oxidation, ablation, transparentization, etc. of the black metal layer).

DETAILED DESCRIPTION OF THE INVENTION

Figure 1:
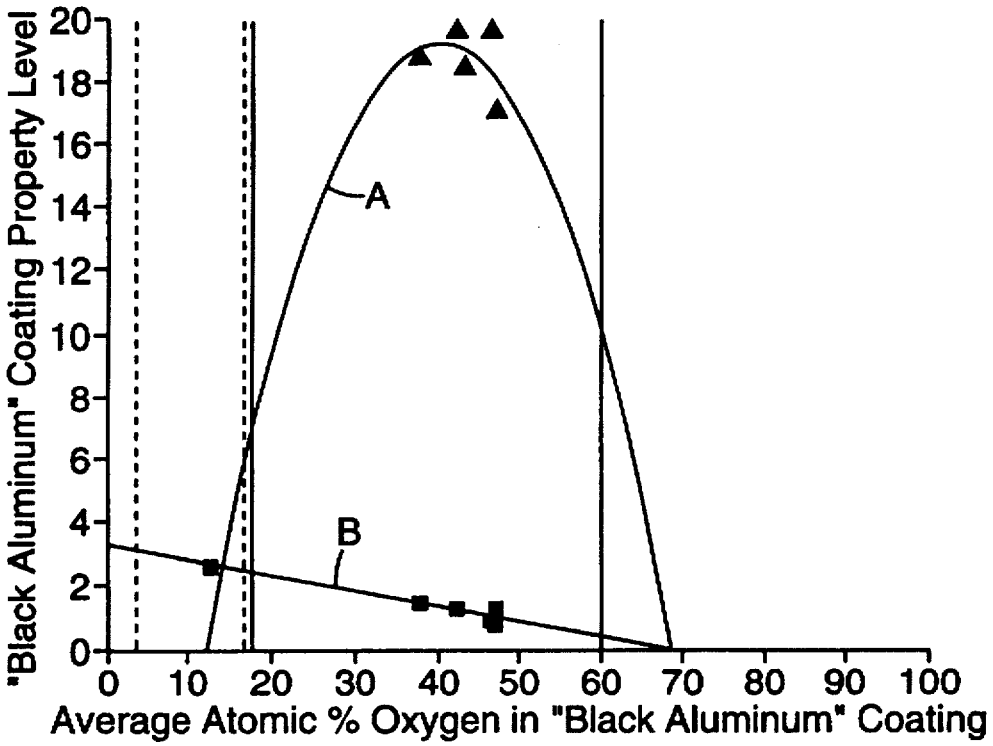
FIG. 1 shows a graph of the average atomic percentage of oxygen in an aluminum aluminum oxide coating on polyester versus Coating Property Levels and Transmission Optical Density. The "Coating Property Level" is the size of a dot which would be produced by laser exposure (at 2.2 W, 16 m/s) at the various compositional values of Oxygen versus Aluminum.

Thermal transfer elements or donor elements of the present invention comprise a substrate coated on at least a surface thereof with a black metal layer in which the transmissivity of the medium is substantially increased in the irradiated region during the imaging process, but without the presence of a propellant layer comprising a gas-producing polymer having a thermally available nitrogen content greater than about 5 weight percent. Preferably, the imaging process occurs at a temperature below about 300° C., and most preferably, below about 250° C.

The gas-producing polymers excluded from the constructions of the present invention are any polymers that liberate gas (especially nitrogen gas, $N_2$) when heated rapidly, such as, for example, by exposure to an infrared laser beam. Polymers that liberate gases such as nitrogen gas on heating generally have thermally decomposable functional groups. Non-limiting examples of thermally decomposable functional groups include azido, alkylazo, diazo, diazonium, diazirino, nitro, nitrato, triazole, etc. The thermally decomposable groups are usually incorporated into gas-producing polymers either prior to polymerization or by modification of an existing polymer, such as, for example, by diazotization of an aromatic amine (e.g., with nitrous acid) or diazo transfer with tosyl azide onto an amine or β-diketone in the presence of triethylamine.

Suitable donor substrates include glass, plastic sheets, and films, preferably transparent polymeric film (although reasonable levels of translucency are also useful, depending upon the resolution required in the image) such as those made of polyesters (e.g., polyethylene terephthalate, polyethylene naphthalate), fluorene polyester polymer consisting essentially of repeating interpolymerized units derived from 9,9-bis(4-hydroxyphenyl)fluorene and isophthalic acid, terephthalic acid or mixtures thereof, polyethylene, polypropylene, polyvinyl chloride and copolymers thereof, hydrolyzed and unhydrolyzed cellulose acetate. Preferably the donor substrate is transparent.

Each surface of the substrate may be treated (e.g., primed, etc.) according to various techniques known in the art to provide different properties and characteristics (e.g., adhesion promotion, release, etc.) to surfaces of materials as may be desired for use in any particular application.

The black metal layer is black aluminum having an atomic proportion of at least 19% oxygen atoms and less than 58% oxygen atoms compared to the total number of atoms of aluminum and oxygen. More preferably the black aluminum comprises at least 20 percent, more preferably at least 22% and most preferably at least 25 atomic percent oxygen compared to the total number of aluminum and oxygen atoms. The black aluminum preferably has less than 57%, more preferably less than 56% and most preferably less than 55% oxygen atoms compared to the total number of oxygen and aluminum atoms. The theoretic maximum of oxygen concentration is 60% for pure $Al_2O_3$, pure alumina, but this would be transparent, not black. The imaging sensitivity levels, as shown in FIG. 1, are highest above 19% and below 60%. Much better performance of the system occurs within these ranges. The levels of atomic percentage of oxygen shown in U.S. Pat. No. 4,188,214 are outside this optimal performance range, being on the order of 3.5 to 16%. A Coating Property Value identified in FIG. 1 is the width of a line in μm that would be produced by scanning with the 1064 nm laser (at 2.2 W, 16 m/s, 26 μm spot) at the various compositions of the black aluminum. Black aluminum layers according to the present invention may be produced according to the teachings of U.S. Pat. No. 4,430,366. By the term "black" it is meant that the metal layer provides a white light transmission optical density measured from the direction of irradiation of at least 0.3, preferably at least 0.6, more preferably at least 0.8, and most preferably at least 1.0, and the reflection optical density measured from the direction of irradiation is at least 0.1, preferably at least 0.2, more preferably at least 0.3, and most preferably at least 0.4.

Substantially any metal capable of forming an oxide or sulfide can be used in the practice of this invention for the black metal layer. In particular aluminum, tin, chromium, nickel, titanium, cobalt, zinc, iron, lead, manganese, copper and mixtures thereof can be used. Not all of these metals when converted to metal oxides according to this process will form materials having all of the specifically desirable properties (e.g., optical density, light transmissivity, absorptivity, etc.). However, all of these metal oxide containing layers formed according to the practice of the present invention will be useful and contain many of the benefits of the present process including bondability to polymeric materials. The metal vapors in the chamber may be supplied by any of the various known techniques suitable for the particular metals, e.g., electron beam heating evaporation, resistance heating evaporation, sputtering, etc. Reference is made to *Vacuum Deposition of Thin Films*, L. Holland, 1970, Chapman and Hall, London, England with regard to the many available means of providing metal vapors and vapor coating techniques, in general.

Metal oxide or metal sulfide containing layers, the black metal layers according to the present invention may be deposited as thin as layers of molecular dimensions up through dimensions in micrometers. The composition of the layer throughout its thickness may be readily controlled as herein described. Preferably the metal/metal oxide or sulfide layer will be between 50 and 5000 Å in its imaging utilities, but may contribute bonding properties when 15 Å, 25 Å or smaller and structural properties when $5\times10^4$ Å or higher.

The conversion to graded metal oxide or metal sulfide is effected by the introduction of oxygen, sulfur, water vapor or hydrogen sulfide at points along the metal vapor stream. By thus introducing these gases or vapors at specific points along the vapor stream in the vapor deposition chamber, a coating of a continuous or graded composition (throughout either thickness of the layer) may be obtained. By selectively maintaining a gradation of the concentration of these reactive gases or vapors across the length of the vapor deposition chamber through which the substrate to be coated is being moved, an incremental gradation of the composition of the coating layer (throughout its thickness) is obtained because of the different compositions (i.e., different ratios of oxides or sulfides to metals) being deposited in different regions of the vapor deposition chamber. One can in fact deposit a layer comprising 100% metal at one surface (the top or bottom of the coating layer) and 100% metal oxide or sulfide at the other surface. This kind of construction is a particularly desirable one because it provides a strong coherent coating layer with excellent adhesion to the substrate.

A substrate which is to be coated continuously moves along the length of the chamber from an inlet area of the vapor deposition chamber to an outlet area. Metal atom vapor is deposited over a substantial length of the chamber, and the proportion of metal oxide or sulfide being codeposited with the metal at any point along the length of the chamber (or deposited as 100% oxide or sulfide) depends upon the amount of reactive gas or vapor which has entered that portion of the metal vapor stream which is being deposited at that point along the length of the chamber. Assuming, for purposes of illustration, that an equal number of metal atoms (as metal or oxides or sulfides are being deposited at any time at any point along the length of the chamber, gradation in the deposited coating is expected by varying the amount of oxygen or sulfur containing reactive gas or vapor which contacts the metal atom vapor or deposited film at various points or areas along the length of the chamber. By having a gradation of increasing amounts of reactive gas along the length of the chamber, one gets a corresponding gradation in the increased proportions of oxide or sulfide deposited. Deposition of metal vapor is seldom as uniform as that assumed, but in actual practice it is no more difficult according to the procedures of the present invention to locally vary the amount of oxygen, water, sulfur or hydrogen sulfide introduced into different regions of said metal vapor along the length of the surface of the substrate to be coated as the substrate is moved so as to coat the surface with a layer having varying ratios of metal/(metal oxide or sulfide) through its thickness. It is desirable that the reactive gas or vapor enter the stream itself and not just diffuse into the stream. The latter tends to cause a less controllable distribution of oxides within the stream. By injecting or focussing the entrance of the reactive gas or vapor into the stream itself, a more consistent mixing in that part of the stream is effected.

Transitional characteristics bear an important relationship to some of the properties of the black metal products. The coating has dispersed phases of materials therein, one the metal and the other the metal oxide or sulfide. The latter materials are often transparent or translucent, while the former are opaque. By controlling the amount and size distribution of particulate metal which remains dispersed in the transparent oxide or sulfide phase, the optical properties of the coating can be dramatically varied. Translucent coatings of yellowish, tan, and gray tones may be provided, and substantially opaque black film may be provided from a single metal by varying the percentage of conversion of the metal to oxide during deposition of the coating layer.

The black metal layer of the imaging element may optionally contain or, either prior to or after the imaging process, be treated with a liquid to aid in the removal of debris remaining on the surface of the imaging element after the imaging process has been completed. Examples of suitable liquids for use in this process include materials such as oils, lubricants, and plasticizers. Examples of suitable liquids include mineral oil, peanut oil, silicone oil, oleic acid, lactic acid, and commercially available lubricants (e.g., WD-40™, WD-40 Corp, San Diego, Calif.). The liquid treatment may be desirable to use when the imaging element comprises a polymeric film substrate such as polyethylene terephthalate, especially when the substrate comprises a microstructured surface. The debris remaining on the surface of the imaging element after the imaging process has been completed can be removed by a light buffing with a suitable material (e.g., cotton ball or cloth, fabric, tissue, brush, etc.) when the imaging element contains or has been treated with a suitable liquid.

The thermally imageable elements of the present invention are used by placing them either with a free space above the black metal layer (to allow it to quickly leave the surface) or in intimate contact (e.g., vacuum hold-down) with a receptor sheet and imagewise heating the thermal transfer donor element. In order to provide rapid heating, one or more laser beams are used to provide the energy necessary for transfer. Single-mode laser diodes and diode-pumped lasers producing 0.1–4 Watt (W) in the near-infrared region of the electromagnetic spectrum are examples of devices which may be used as energy sources. Any device which can provide finely tuned radiation at the required energy levels and which can be absorbed by the black metal (which includes most wavelengths of radiation as the black metal absorbs on the basis of physical attenuation of the radiation into the optical structure of the black metal rather than typical color absorption as occurs with dyes and pigments). Preferably, a solid state infrared laser or laser diode array is employed. Laser exposure dwell times may be from 0.01 to 10 microseconds, and preferably are from about 0.1 to 5 microseconds and laser fluences should be from about 0.005 to about 5 J/cm$^2$.

The thermally imageable elements of the present invention may be imaged by directing the radiation towards the black metal coated side of the element. As an alternative embodiment, when using a transparent substrate the imageable element of the present invention may be imaged by directing the radiation towards the substrate side of the element. The process for thermal generation of an image on a substrate comprises the steps of a) providing an element comprising a substrate having coated on at least a portion thereof a layer comprising a black aluminum layer comprising from at least 19 percent oxygen to less than 58 atomic percent oxygen compared to the total number of atoms of oxygen and aluminum, said black aluminum having a transmission optical density of at least 0.3 at a wavelength between 200 and 1100 nm, b) projecting radiation at a wavelength between 220 and 1100 nm at said element in an imagewise distribution, c) said projected radiation substantially increasing the light transmissivity of the element in areas corresponding to where said radiation strikes said element, said element being free of any gas-producing polymer having a thermally available gas content of greater than 5 weight percent. The reflection optical density of said black aluminum at a wavelength between 200 and 1100 nm, when measured from the direction of irradiation in the process, is at least 0.1.

The black metal acts as a radiation absorber which sensitizes the thermally imageable element to various wavelengths of radiation. The black metal serves to convert incident electromagnetic radiation into sufficiently high levels of heat or thermal energy to substantially increase the light transmissivity of the medium in the irradiated region. The amount of radiation absorbed is dependent on the thickness of the black metal layer, the inherent absorption and reflection characteristics of the black metal material, and the intensity of the incident radiation. For a fixed incident radiation intensity, the amount of radiation absorbed by the medium will be proportional to the fraction of radiation absorbed by the corresponding medium. The fraction of radiation absorbed is in turn dependent on the transmission optical density (TOD=−logT where T is the fractional transmittance) and reflection optical density (ROD=−logR where R is the fractional reflectance) and is calculated by the equation:

Fraction Radiation Absorbed$=1-10^{-TOD}-10^{-ROD}=1-T-R$ for both TOD and ROD at the wavelength of irradiation. It is generally desirable for the radiation absorber to be highly absorptive of the incident radiation so that a minimum amount can be used in coatings, yet a sufficiently high optical density can be provided.

In the practice of the present invention, the thermally imageable element is positioned so that upon application of heat, the black metal material is transferred from the donor element to the receiving element or disposed of away from the element. A variety of light-emitting sources can be utilized in the present invention including high powered gas lasers, infrared, visible, and ultraviolet lasers. The preferred lasers for use in this invention include high power (>100 mW) single mode laser diodes, fiber-coupled laser diodes, and diode-pumped solid state lasers (e.g., Nd:YAG and Nd:YLF), and the most preferred lasers are diode-pumped solid state lasers. The laser exposure should locally (in an imagewise distributed pattern) raise the temperature of the thermal transfer medium above 150° C. and most preferably above 200° C.

The thermally imageable element can be provided as sheets or rolls. The following non-limiting examples further illustrate the present invention.

EXAMPLES

Example 1

Black aluminum coatings were prepared by introducing a less than stoichiometric amount of oxygen into the aluminum vapor stream of a vapor coater equipped with an aluminum roll with or without chilling water. The continuous coatings were carried out at 60 ft/min.

Samples 1–4 were prepared by coating a black aluminum layer of varying thickness on 4 mil polyester. The white light optical densities (O.D.) were measured for each sample using a Macbeth densitometer. The O.D. for each sample is listed in Table 1.

The samples were then imaged using a sensitometer based on a diode pumped Nd:YLF laser. A galvanometer was used to sweep the beam across a lens which focused the beam to a spot 18 μm full width half maximum (FWHM). The power on the film plane was 700 mW and the beam sweep speed was 650 cm/sec at the film plane. Samples 1–4 were imaged with the black aluminum coating facing the laser beam and exposed to air. The width of the imaged line segments were measured using an optical microscope and are listed in Table 1.

TABLE 1

Samples imaged from the black aluminum side

| Sample | O. D. | Linewidth |
|---|---|---|
| 1 | 0.65 | 30 μm |
| 2 | 1.17 | 30 μm |
| 3 | 2.9 | 30 μm |
| 4 | 3.5 | 30 μm |

The average sensitivity across the laser spot is calculated to be 0.36 J/cm$^2$ for these exposures.

Example 2

A series of vapor deposited aluminum coating samples were prepared under conditions similar to Example 1 except that the rate of aluminum deposition and the oxygen supply were varied. All coatings were prepared using 4 mil polyethylene terephthalate (PET) as the substrate and a web speed of 2 ft./min. unless indicated otherwise. Thickness measurements of the resulting samples (determined by profilometry after masking and etching a portion of the coating with 20 percent by weight aqueous sodium hydroxide) are listed in Table 2.

TABLE 2

Prepartion of vapor coated aluminum samples

| Sample | Emission Current, mA | $O_2$ Flow, sccm[a] | Thickness, Å |
|---|---|---|---|
| 66 | 580 | 0 | 383 |
| 83 | 585 | 25 | 643 |
| 103 | 660 | 25 | 945 |
| 133 | 662 | 35 | 905 |
| 163 | 662 | 50 | 1000 |
| 188 | 662 | 0 | 688 |
| 213 | 800 | 50 | 2175 |
| 243 | 800 | 70 | 2505 |
| 273 | 800 | 100 | 2665 |
| 303 | 800 | 115 | 2683 |
| 336 | 800 | 120 | 2853 |
| 366 | 800 | 0 | 1665 |
| 390 | 750 | 80 | 1972 |
| 420 | 750 | 60 | 1535 |
| 450 | 750 | 100 | 1920 |
| 480 | 750 | 50 | 1875 |
| 510 | 750 | 70 | 1557 |
| 645[b] | 750 | 0 | 1057 |
| 660[b] | 750 | 70 | 3532 |

[a]sccm ≡ standard cubic centimeters per minute [b]web speed was 0.75 ft./min.

XPS compositional depth profiles to be 36.7% for Sample 103, 46.4% for Sample 133,46.9% for Sample 163,13.7% (outside the scope of the invention) for Sample 188 and 12.3% (outside the scope of the invention) for Sample 645. Sample 188, although imaging, had a thickness of only 688 Angstroms and provided low optical density. Sample 645 (also outside the scope of the invention) had an average atomic percentage of oxygen of 12.3% and did not image at the 1057 Angstrom thickness which was necessary to obtain the desired initial optical density.

Example 3

The transmission and reflection spectra of the vapor coated aluminum samples of Example 2 were measured from the coating side using a Shimadzu MPC-3100 spectrophotometer with an integrating sphere. The transmission optical density (TOD) and reflection optical density (ROD≡−logR, where R is the measured fractional reflectance) at 380 and 1060 nm are listed in Table 3. The samples were then imaged from the coated side with a Nd:YAG laser (2.2 W) using a 25 μm spot (measured at full width 1/e$^2$) at 16 m/sec. The widths of the imaged line segments are listed in Table 3.

TABLE 3

Coated Side Imaging and Spectral Data

| | TOD (at λ, nm) | | ROD (at λ, nm) | | | Linewidth |
|---|---|---|---|---|---|---|
| Sample | 380 | 1060 | 380 | 1060 | F. R. A.[a] | μm, |
| 66 | 0.76 | 1.20 | 0.18 | 0.10 | 0.14 | 16.3 |
| 83 | 0.50 | 0.35 | 0.64 | 0.66 | 0.33 | 21.8 |
| 103 | 1.17 | 1.02 | 0.74 | 0.30 | 0.41 | 24.6 |
| 133 | 1.26 | 0.83 | 0.85 | 0.43 | 0.48 | 25.7 |
| 163 | 0.72 | 0.41 | 1.12 | 0.60 | 0.36 | 22.8 |
| 188 (Comp[b]) | 2.00 | 2.26 | 0.08 | 0.04 | 0.08 | 12.5 |
| 213 | 3.25 | 2.64 | 0.69 | 0.78 | 0.83 | 18.1 |
| 243 | 3.02 | 1.77 | 1.01 | 0.80 | 0.83 | 20.9 |
| 273 | 2.25 | 0.94 | 1.66 | 0.90 | 0.76 | 19.8 |
| 303 | 1.74 | 0.60 | 1.69 | 0.90 | 0.63 | 17.9 |
| 336 | 1.40 | 0.47 | 1.74 | 0.84 | 0.51 | 16.1 |
| 366 (Comp[b]) | 2.37 | 2.33 | 0.35 | 0.05 | 0.10 | 0 |
| 390 | 1.48 | 0.65 | 1.48 | 0.61 | 0.53 | 18.2 |
| 420 | 2.00 | 1.08 | 1.01 | 0.55 | 0.64 | 19.9 |
| 450 | 0.95 | 0.35 | 1.55 | 0.66 | 0.33 | 10.7 |
| 480 | 2.44 | 1.51 | 0.92 | 0.51 | 0.66 | 19.2 |
| 510 | 1.85 | 0.91 | 1.26 | 0.62 | 0.63 | 18.9 |
| 645 (Comp[b]) | 2.65 | 2.59 | 0.68 | 0.07 | 0.14 | 0 |
| 660 | 4.28 | 2.49 | 2.01 | 1.19 | 0.93 | N. D.[c] |

[a]F. R. A. is the fraction of radiation absorbed at 1060 nm. and is calculated as F. R. A. = $1-10^{-TOD}-10^{-ROD}$ for both TOD and ROD at 1060 nm.
[b]Comparative Examples.
[c]Not Determined.

Example 4

A series of vapor deposited aluminum coating samples was prepared under conditions similar to those described in Example 2, except that the web speeds were varied as indicated. Thickness measurements were determined as described in Example 2 and are listed in Table 4.

TABLE 4

Prepartion of vapor coated aluminum samples

| Sample | Emission Curr. mA | $O_2$ Flow sccm | Web Speed (ft/min) | Thickness Å |
|---|---|---|---|---|
| 427 | 780 | 0 | 3.00 | 557 |
| 453 | 830 | 25 | 2.40 | 1272 |

TABLE 4-continued

Prepartion of vapor coated aluminum samples

| Sample | Emission Curr. mA | $O_2$ Flow sccm | Web Speed (ft/min) | Thickness Å |
|---|---|---|---|---|
| 474 | 830 | 25 | 3.60 | 883 |
| 498 | 830 | 45 | 3.60 | 888 |
| 520 | 780 | 35 | 3.00 | 943 |
| 558 | 730 | 45 | 2.40 | 922 |
| 574.5 | 730 | 25 | 3.60 | 557 |
| 578 | 730 | 25 | 2.40 | 727 |
| 610 | 780 | 53 | 3.00 | 847 |
| 626 | 780 | 35 | 3.00 | 1158 |
| 642 | 869 | 35 | 3.00 | 1093 |
| 663 | 830 | 45 | 2.40 | 1317 |
| 680 | 780 | 35 | 4.10 | 505 |
| 700 | 691 | 35 | 3.00 | 380 |
| 718 | 780 | 17 | 3.00 | 568 |
| 738 | 780 | 35 | 1.90 | 1070 |
| 753 | 780 | 35 | 3.00 | 740 |
| 768 | 830 | 25 | 3.60 | 862 |
| 797 | 780 | 35 | 3.00 | 955 |

Examle 5

The transmission and reflection spectra of the vapor coated aluminum samples of Example 4 were measured as in Example 3, except from the substrate side. The TOD and ROD at 380 and 1060 nm are listed in Table 5. The samples were then imaged from the substrate side with a Nd:YAG laser (4.6 W) using a 25 μm spot (measured at full width $1/e^2$) at 64 m/sec. The widths of the imaged line segments are listed in Table 5.

TABLE 5

Substrate Side Imaging and Spectral Data

| | TOD (at λ, nm) | | ROD (at λ,nm) | | | Linewidth |
|---|---|---|---|---|---|---|
| Sample | 380 | 1060 | 380 | 1060 | F. R. A.* | μm. |
| 427 | 0.96 | 0.84 | 0.64 | 0.47 | 0.52 | 28.8 |
| 453 | 2.23 | 2.13 | 0.36 | 0.14 | 0.26 | 22.5 |
| 474 | 1.43 | 1.73 | 0.33 | 0.15 | 0.28 | 22.6 |
| 498 | 1.29 | 1.07 | 0.64 | 0.36 | 0.48 | 29.4 |
| 520 | 1.28 | 1.11 | 0.61 | 0.32 | 0.45 | 26.0 |
| 558 | 1.04 | 0.71 | 0.79 | 0.63 | 0.57 | 28.5 |
| 574.5 | 0.85 | 1.03 | 0.57 | 0.30 | 0.41 | 27.9 |
| 578 | 1.00 | 0.99 | 0.58 | 0.36 | 0.46 | 28.2 |
| 610 | 0.91 | 0.61 | 0.80 | 0.76 | 0.58 | 27.5 |
| 626 | 1.18 | 1.01 | 0.60 | 0.36 | 0.47 | 29.4 |
| 642 | 1.83 | 1.65 | 0.52 | 0.20 | 0.34 | 24.2 |
| 663 | 1.50 | 0.97 | 0.81 | 0.45 | 0.54 | 27.7 |
| 680 | 0.73 | 0.71 | 0.71 | 0.58 | 0.54 | 30.4 |
| 700 | 0.51 | 0.35 | 0.86 | 1.11 | 0.47 | 27.4 |
| 718 | 0.92 | 1.20 | 0.49 | 0.24 | 0.36 | 26.9 |
| 738 | 1.71 | 1.25 | 0.69 | 0.30 | 0.45 | 26.6 |
| 753 | 1.14 | 1.01 | 0.59 | 0.36 | 0.46 | 28.6 |
| 768 | 1.39 | 1.74 | 0.33 | 0.15 | 0.28 | 23.7 |
| 797 | 1.48 | 1.18 | 0.56 | 0.31 | 0.44 | 25.6 |

*F. R. A. is the fraction of radiation absorbed at 1060 nm, and is calculated as F. R. A. = $1-10^{-TOD}-10^{-ROD}$ for both TOD and ROD at 1060 nm.

Example 6

Microstructured PET film was prepared by sputter coating PET with chromium and etching with oxygen plasma. The microstructured PET film was vapor coated with black aluminum and resulted in a transmission optical density of 1.45. Samples of the film were treated with a lubricant commercially available as WD-40™ (WD-40 Company, San Diego, Calif.) and imaged as in Example 1 except the power on the film plane was 3.3 W and the laser spot size was 26 microns at the $1/e^2$ points. Linewidths for the untreated and lubricant treated samples are given in Table 6.

TABLE 6

| | Linewidth, μm. | |
|---|---|---|
| Speed (m/s) | Lubricant | Untreated |
| 192 | 10 | 0 |
| 160 | 12 | 0 |
| 128 | 16 | 10 |
| 96 | 17 | 11 |

A light buffing of the imaged area of the sample treated with lubricant had the effect of removing much of the remaining aluminum particles and other debris resulting from the imaging process. Buffing the imaged areas of the untreated sample did not result in significant removal of the debris.

Example 7

Microstructured PET films prepared as described in Example 6 were vapor coated with either aluminum or copper at a coating thickness of 1000 Å. The samples were imaged as in Example 1 except that the samples were imaged from the substrate side, the power on the film plane was 1.2 W, and the beam sweep speed was 48 m/sec. The width of the imaged line segments were 10 μm.

Example 8

Plain and microstructured PET films (prepared as described in Example 6) were vapor coatted with black tin. The samples were imaged as in Example 1 except that the samples were imaged from the substrate side, the power on the film plane was 2.1 W, and beam sweep speeds of 16,32,48, and 64 m/sec were used. The black tin was transparentized cleanly in the imaged areas of both samples.

Example 9

A series of black aluminum coatings were deposited onto 4 mil polyethylene terephthalate (PET) substrate via sputtering of Al in an $Ar/O_2$ atmosphere in which the sputtering voltage, system pressure, $Ar/O_2$ flow ratio, and substrate transport speed were varied in a continuous vacuum coater as indicated in Table 7. Thickness measurements of the resulting samples were performed as described in Example 2 and are also listed in Table 7.

TABLE 7

Preparation of Sputtered Black Aluminum Samples

| Sample | Sputtering Voltage | Pressure $10^{-3}$ torr | $O_2$/Ar Ratio | Speed ft/min | Thickness (Å) |
|---|---|---|---|---|---|
| A (Comp*) | 474 | 5.4 | 0.000 | 1.5 | 2002 |
| B | 482 | 5.5 | 0.025 | 1.5 | 2280 |
| C | 494 | 5.2 | 0.067 | 1.5 | 2423 |
| D (Comp*) | 419 | 13.0 | 0.000 | 1.5 | 1043 |
| E | 428 | 13.0 | 0.008 | 1.5 | 1273 |
| F | 440 | 13.0 | 0.022 | 1.5 | 1957 |
| G (Comp*) | 503 | 5.5 | 0.000 | 4.5 | 847 |
| H | 495 | 5.1 | 0.025 | 4.5 | 962 |
| I | 492 | 5.4 | 0.067 | 4.5 | 963 |
| J (Comp*) | 443 | 13.0 | 0.000 | 4.5 | 450 |
| K | 438 | 13.0 | 0.008 | 4.5 | 480 |

*Comparative Examples.

Example 10

The transmission and reflection spectra of the samples described in Table 7 were measured as in Example 5. The TOD and ROD were measured at 380 and 1060 nm and are listed in Table 8. The samples were then imaged from the substrate side with a Nd:YAG laser (3.2 W) using a 25 μm spot at 64 m/sec. The widths of the imaged line segments are also listed in Table 8.

TABLE 8

Substrate Side Spectral Data and Imaging of Sputtered Samples

| | TOD (at λ, nm) | | ROD (at λ, nm) | | | Linewidth |
|---|---|---|---|---|---|---|
| Sample | 380 | 1060 | 380 | 1060 | F. R. A.[a] | μm. |
| A (Comp[b]) | 4.40 | 4.41 | 0.13 | 0.06 | 0.13 | 0.0 |
| B | 5.00 | 4.11 | 0.37 | 0.13 | 0.26 | 0.0 |
| C | 5.00 | 1.71 | 0.66 | 0.63 | 0.75 | 20.3 |
| D (Comp[b]) | 3.46 | 3.13 | 0.14 | 0.07 | 0.14 | 0.0 |
| E | 1.76 | 0.69 | 0.79 | 0.61 | 0.55 | 21.3 |
| F | 0.57 | 0.11 | 1.04 | 0.80 | 0.07 | 0.0 |
| G (Comp[b]) | 2.94 | 2.87 | 0.15 | 0.07 | 0.15 | 0.0 |
| H | 2.01 | 2.04 | 0.36 | 0.14 | 0.26 | 14.9 |
| I | 1.69 | 0.71 | 0.65 | 0.48 | 0.47 | 22.7 |
| J(Comp[b]) | 1.51 | 1.91 | 0.18 | 0.09 | 0.17 | 20.0 |
| K | 0.77 | 0.51 | 0.61 | 0.84 | 0.55 | 24.9 |

[a]F. R. A. is the fraction of radiation absorbed at 1060 nm. and is calculated as F. R. A. = $1-10^{-TOD}-10^{-ROD}$ for both TOD and ROD at 1060 nm.
[b]Comparative Examples.

We claim:

1. A process for the thermal generation of an image on a substrate comprising the steps of a) providing an element comprising a substrate having coated on at least a portion thereof a layer comprising black aluminum comprising from at least 19 atomic percent oxygen to less than 58 atomic percent oxygen compared to the total number of atoms of aluminum and oxygen, said black aluminum having a transmission optical density of at least 0.3 at a wavelength between 200 and 1100 nm, b) projecting radiation at a wavelength between 220 and 1100 nm at said element in an imagewise distribution, c) said projected radiation substantially increasing the light transmissivity of the element in areas corresponding to where said radiation strikes said element, said element being free of any gas-producing polymer having a thermally available gas content of greater than 5 weight percent.

2. The process of claim 1 wherein said projected radiation is infrared radiation having a wavelength between 720 and 1100 nm.

3. The process of claim 1 wherein said projected radiation comprises wavelengths between 500 and 720 nm.

4. The process of claim 1 wherein said projected radiation comprises wavelengths between 220 and 500 nm.

5. The process of claim 1 wherein said black aluminum having an average atomic percentage of oxygen as compared to the total of oxygen and aluminum atoms being between 20% and 57%.

6. The process of claim 5 wherein said black aluminum comprising a mixture of aluminum and aluminum oxide.

7. The process of claim 1 wherein said surface having black aluminum thereon is not in contact with another surface when projected radiation strikes it.

8. The process of claim 5 wherein said surface having black aluminum thereon is not in contact with another surface when projected radiation strikes it.

9. The process of claim 1 wherein said projecting radiation is from a laser or laser diode array.

10. The process of claim 5 wherein said projecting radiation is from a laser or laser diode array.

11. The process of claim 7 wherein said projecting radiation is from a laser or laser diode array.

12. The process of claim 1 wherein the reflection optical density at a wavelength between 200 and 1100 nm measured from the direction of radiation is at least 0.1.

13. The process of claim 1 wherein the element further comprises a lubricant.

* * * * *

UNITED STATES PATENT AND TRADEMARK OFFICE

CERTIFICATE OF CORRECTION

PATENT NO. : 5,766,827
DATED : June 16, 1998
INVENTOR(S) : Richard E. Bills et al.

It is certified that error appears in the above-identified patent and that said Letters Patent is hereby corrected as shown below:

Column 9,
Line 65, before "XPS" insert -- Average oxygen atomic percentages of some of the samples were determined by --

Signed and Sealed this

Second Day of April, 2002

*Attest:*

*Attesting Officer*

JAMES E. ROGAN
*Director of the United States Patent and Trademark Office*